US007207896B1

(12) United States Patent
Sudol

(10) Patent No.: US 7,207,896 B1
(45) Date of Patent: Apr. 24, 2007

(54) AID FOR TRAINING A GOLF SWING

(76) Inventor: Mark S. Sudol, 4 Greenwood Dr., Kennebunk, ME (US) 04043

( * ) Notice: Subject to any disclaimer, the term of this patent is extended or adjusted under 35 U.S.C. 154(b) by 0 days.

(21) Appl. No.: 11/389,806

(22) Filed: Mar. 27, 2006

(51) Int. Cl.
*A63B 69/36* (2006.01)
*F21L 15/14* (2006.01)

(52) U.S. Cl. ..... 473/268; 473/266; 473/274; 473/207; 473/208; 362/106

(58) Field of Classification Search ..... 473/207–215, 473/219, 220, 266, 268, 269, 274, 275; 362/105, 362/106, 190, 191, 200, 205
See application file for complete search history.

(56) References Cited

U.S. PATENT DOCUMENTS 2,638,532 A * 5/1953 Brady ..... 362/105
5,284,345 A 2/1994 Jehn
5,467,992 A 11/1995 Harkness
6,659,618 B2 * 12/2003 Waters ..... 362/106
6,672,972 B1 1/2004 Stone
6,902,493 B1 6/2005 Rhodes et al.
6,939,245 B1 9/2005 Mullarkey
7,104,670 B2 * 9/2006 Waters ..... 362/200
7,118,241 B2 * 10/2006 Sohn ..... 362/106

* cited by examiner

*Primary Examiner*—Nini F. Legesse
(74) *Attorney, Agent, or Firm*—Patricia M. Mathers; Thomas L. Bohan

(57) ABSTRACT

A training aid for practicing a golf swing. Two laser pointers are mounted at opposite ends of a bar that is affixed to a hat. The laser pointers are horizontally and vertically adjustable and are adjusted such that the laser beams from the two laser pointers cross at a desired point in front of the user. While maintaining the proper stance for a golf swing, the beams are adjusted to intersect each other a short distance above the golf ball. Any movement of the head will cause the beams to shift. This provides immediate feedback to the user and is useful in training the user to execute a golf swing while keeping the head in a certain position and motionless.

13 Claims, 5 Drawing Sheets

AID FOR TRAINING A GOLF SWING

BACKGROUND INFORMATION

1. Field of the Invention

The present invention relates to the field of training aids for sports activities. More particularly, it relates to a training aid to improve a golfer's swing.

2. Description of the Prior Art

In playing the game of golf, a golfer strikes a small ball with the head of a golf club. The ball is laying on the ground or held just off the ground by a tee. The head of the golf club is connected via a relatively long shaft to a handle. The goal is to strike the ball precisely with finesse and with varying degrees of force. This is a challenging task and reliably good swing practice requires that the golfer keep his or her head properly aligned and motionless throughout the swing. This technique is often difficult for a novice golfer to master. Even experienced golfers can lapse into bad habits and lose their swing. Moving the head even to a small degree can have subtle effects on the accuracy of the swing and it is sometimes difficult for the golfer to recognize that he is moving his head during the swing. For this reason, golfers who have a consistently poor swing and can afford it, often hire the services of a coach who can observe their swing technique and point out shortcomings. It is relatively expensive to hire a coach. For those who can't afford a coach, it is often extremely frustrating to try to correct a poor swing, because it is so very difficult to perceive small head movements on oneself during a swing.

Training aids are known that provide a light beam as a guide for the golfer. The light-emitting device is mounted on a cap or headband and adjusted to project a beam of light downward that will hit the golf ball or a spot on the ground a certain distance next to the golf ball when the golfer is in the proper stance for the swing. The disadvantage of such aids is that, with a single beam, or even with parallel beams, certain head movements of the golfer will not result in a change in the endpoint of the projected light beam. For example, a right-handed golfer could shift his body to the right and rotate the head to the left, without the endpoint of the beam moving from the target area. This type of motion of a golfer is quite common, and without the visual feedback from the light beam, the golfer often does not realize that he has moved his head.

What is needed, therefore, is a training device that aids the golfer in training and practicing the proper golf swing. What is further needed is such a training device that is easy to use and set up. What is further needed is such a training device that is transportable.

BRIEF SUMMARY OF THE INVENTION

The above cited needs are satisfied by a training aid that mounts onto headwear, such as a conventional baseball cap or a headband. The training aid comprises two laser pointer devices that are adjustably mounted on the headwear, one on each side of the head. The laser pointers are horizontally and vertically adjustable and are adjusted for use such that the light beams from each laser pointer cross at a certain point in front of the golfer. Use of the training aid will be described as training a golfer's swing. It is understood, however, that the training aid may be used for other applications, and the golfer will be referred to hereinafter as "user".

The user addresses a target, such as a golf ball in a correct stance, with golf club in hand. The user manually adjusts the laser pointers so that, when maintaining the correct stance, the two laser beams cross at a point above the golf ball and continue down on each side of the ball, so as to bracket the golf ball, that is, the light beams are visible at two endpoints on the ground, one on each side of the golf ball. The user now attempts to strike the golf ball with a proper golf swing, keeping the head in the proper position. Any movement of the user's head, in any direction, causes a shift in the endpoints of the light beams that are reflected from the ground. Depending on the movement, one beam may shift closer to and one farther away from the target. or both endpoints may shift closer to or farther away from the target. Whatever the movement and the shift, the user receives instantaneous visual feedback that he has moved his head. The user sees the movement or shift in the light-beam endpoints at the same time he physically experiences body movement. This instantaneous visual signal of movement trains the user to be more attuned to body stance and to be aware of any movement of the head.

The laser pointers are battery operated devices. They can be individually powered by batteries and individually adjusted or connected to a common power source and power switch. Numerous methods of adjustably attaching the lasers are known. The lasers may be mounted directly on headwear or mounted on a mounting bar that is then attached to the headwear. The laser pointers may be mounted individually and be independently adjustable, or ganged together, so that the adjustments to one laser pointer are simultaneously applied to the other laser pointer.

According to the invention, the training aid could have other applications other than as a golf swing training aid. The inventive feature is a pair of light beams that brackets an object and shifts with any movement, whether the movement be in a horizontal or vertical plane or combination thereof.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, the embodiments are provided so that this disclosure will be complete and will fully convey the scope of the invention to those skilled in the art.

Figure 1:
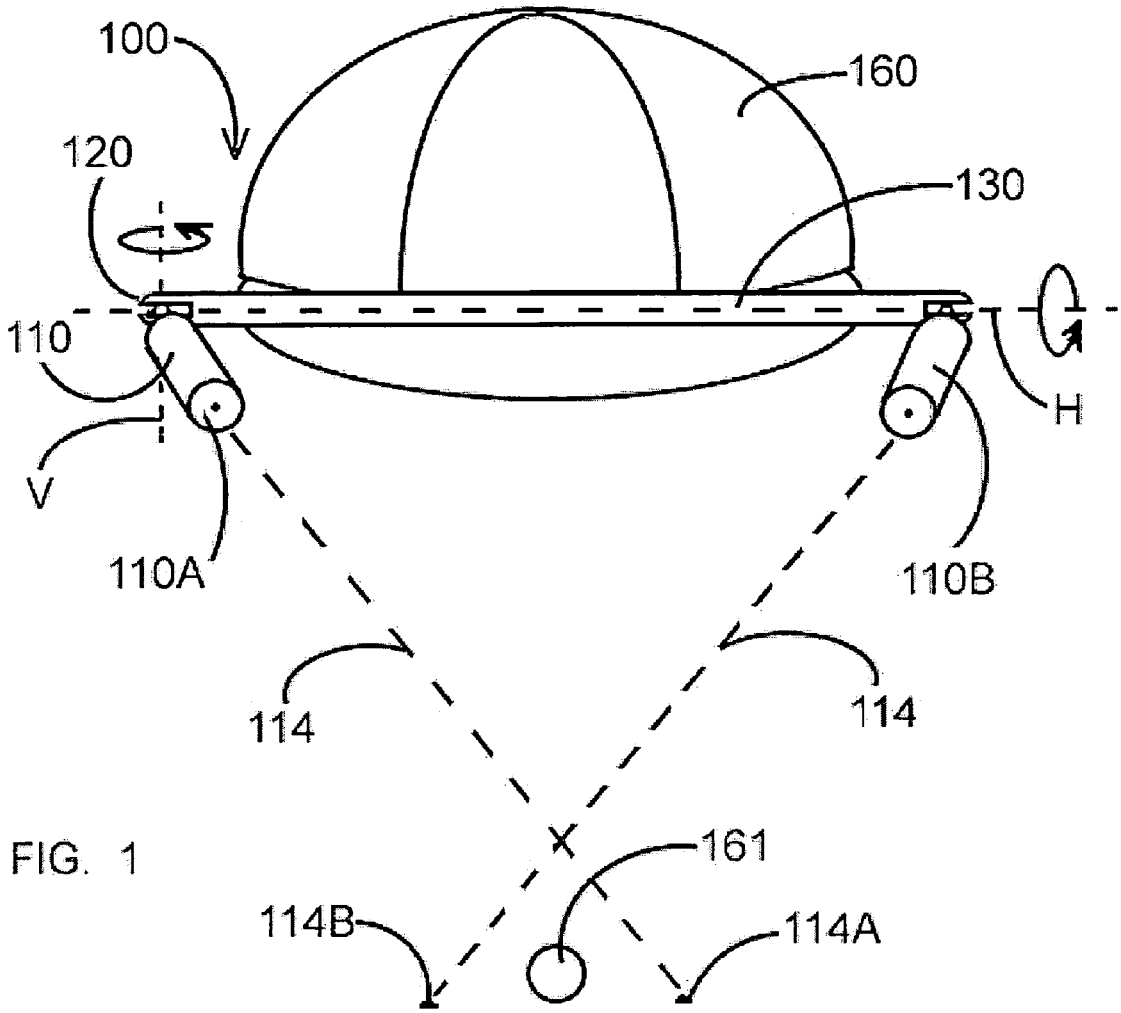
FIG. 1 is an illustration of the training aid according to the invention.

FIG. 1 illustrates a first embodiment of a training aid 100 mounted on headwear 160. The training aid 100 comprises two laser pointers 110, each of which emits a light beam 114, an adjustment means 120 for adjusting the orientation of the laser pointers 110, and a mounting means 130 for mounting the laser pointers 110 on the headwear 160. The laser pointers 110, also referred to individually as a first laser pointer 110A and a second laser pointer 110B, are adjustable such that a first light beam 114A from the first laser pointer 110A crosses with a second light beam 114B from the second laser pointer 110B that bracket a target, such as a golf ball.

Figure 2:
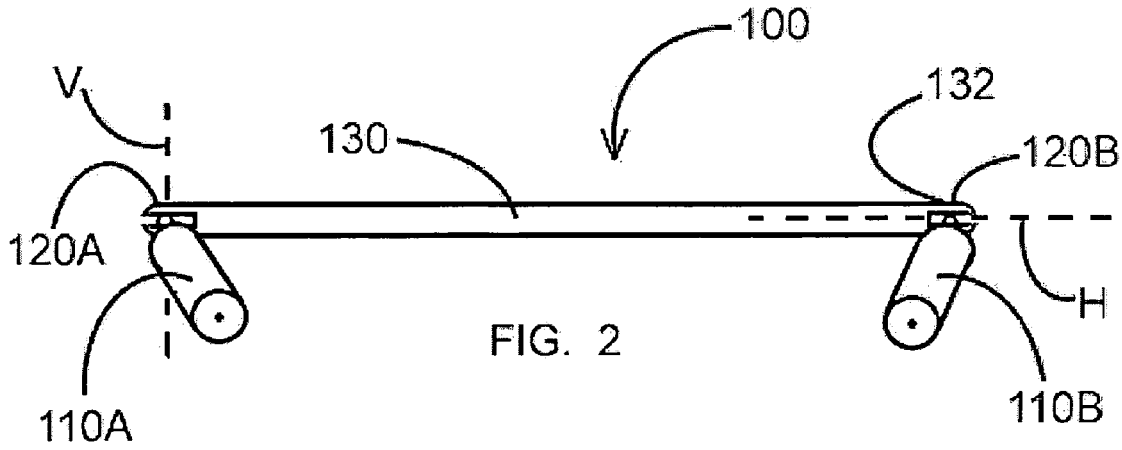
FIG. 2 is a perspective view the first embodiment of the training aid.

FIG. 2 is a perspective view of the training aid 100. The laser pointer adjustment means 120 include fastening means 132 for attaching the first and second laser pointers 110A and 110B, respectively, to the mounting means 130. The mounting means 130 is a bar or platform that extends across the width of standard headwear and the laser pointers 110 are attached to the ends of the mounting bar 130. The fastening means 132 are conventional fastening means, such as, for example, conventional ball-and-socket swivel connectors that allow the laser pointer 110 to rotate in a horizontal plane about a vertical axis V and to rotate in a vertical plane about a horizontal axis H, or releasable clamps, or other type of connection. The laser pointers 110 will generally be forward pointing, so the degree of rotation in the vertical, as well as in the horizontal, direction may be limited to an arc that is sufficient to allow adjustment within a limited forward-facing range. There are numerous possible ways of integrating the laser pointer adjustment means 120 with the fastening means and mounting them to the mounting bar 130 so that the laser pointers 110 are horizontally and vertically adjustable. In this embodiment, the laser pointers 110A/110B each have a respective adjustment means 120A/120B, for horizontal adjustment. Vertical adjustment is achieved by rotating the mounting bar 130 about its axis, which is also the horizontal axis H. It is understood that the scope of the invention is not limited to any particular mounting system. In this first embodiment of the training aid 100, each laser pointer 110 is a self-contained device, having its own power supply and being individually adjustable.

Figure 3A:
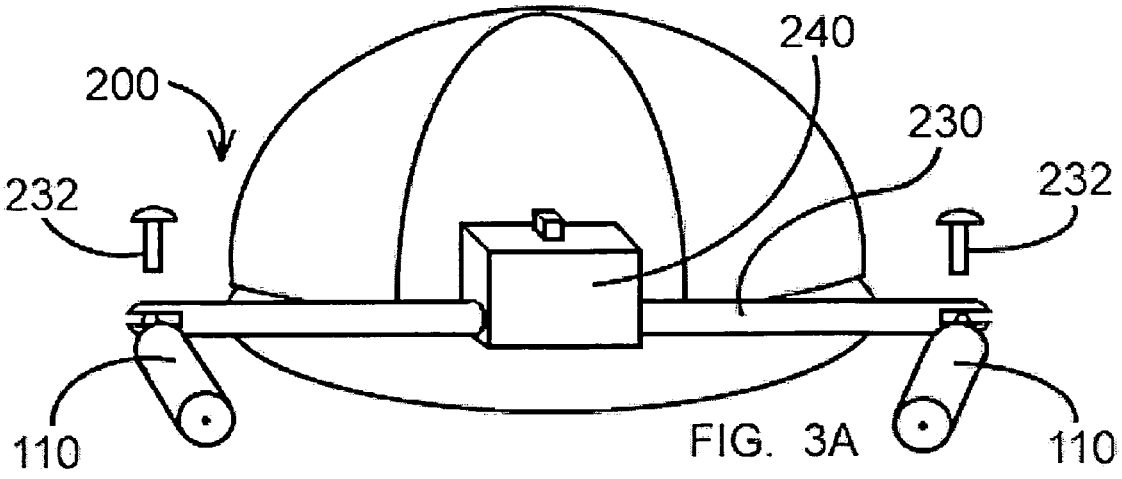
FIG. 3A shows a first embodiment of the training aid, mounted on headwear.
Figure 3B:
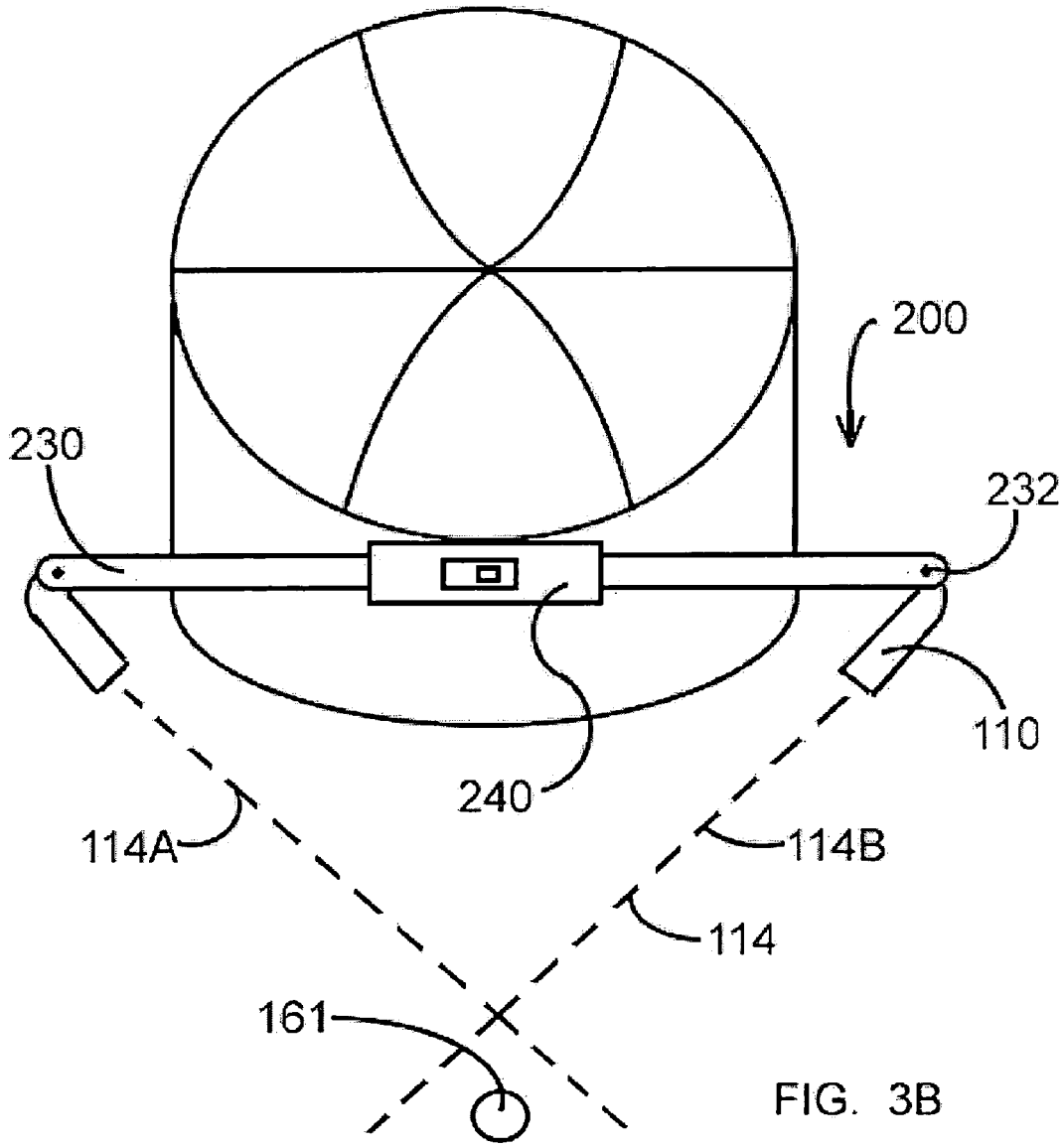
FIG. 3B illustrates the light beams crossing above and bracketing a golf ball.
Figure 4A:
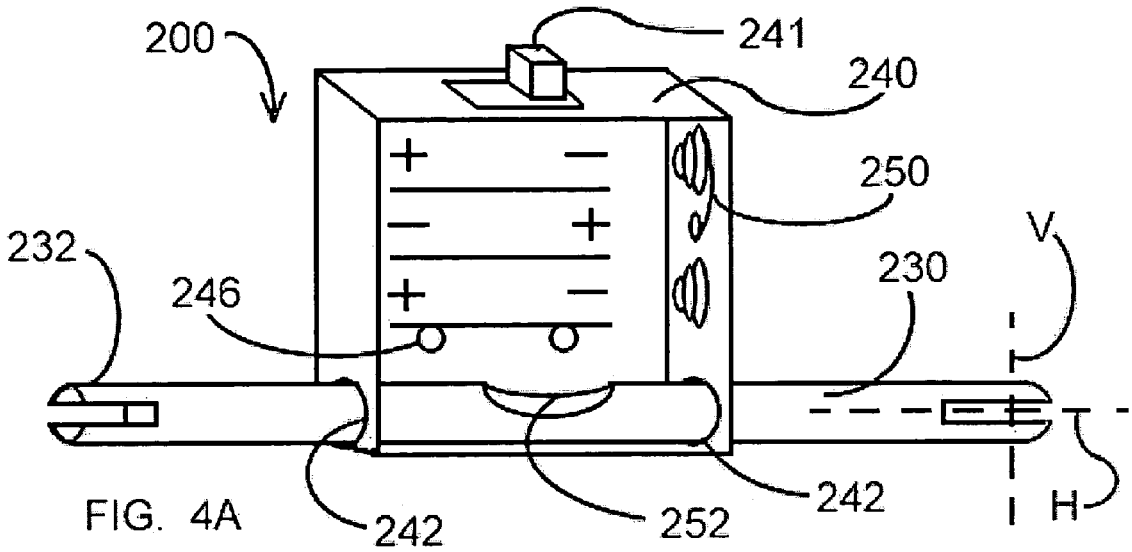
FIG. 4A is a perspective view of the front of the training aid of FIG. 4A, showing the switchbox with battery terminals.
Figure 4B:
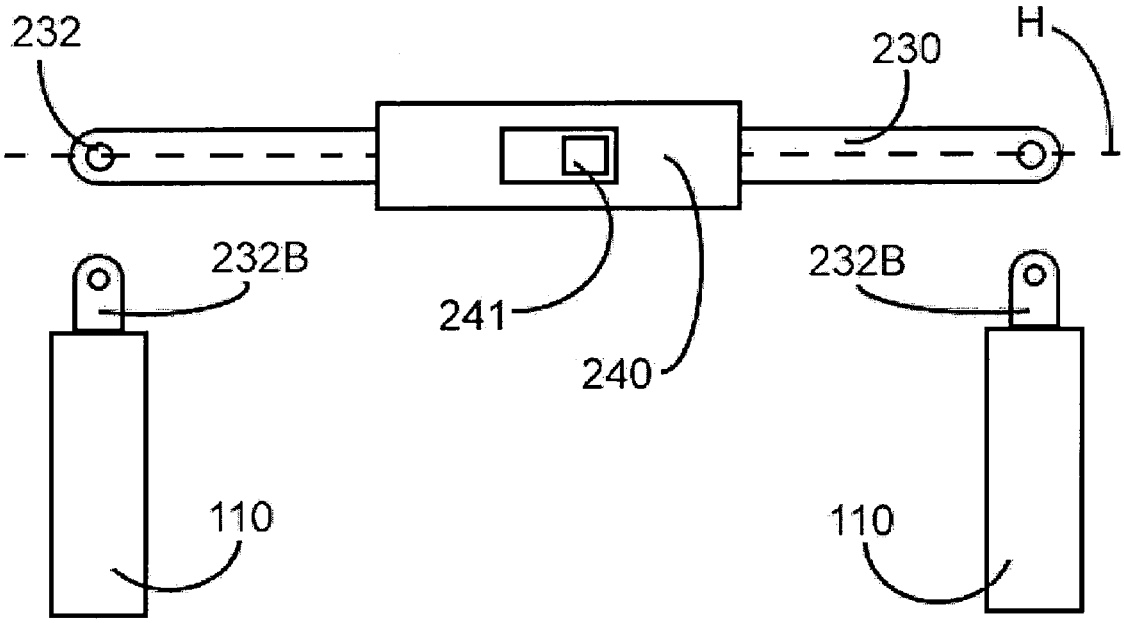
FIG. 4B is a top down view of the first embodiment of the golf training aid, showing the switchbox and switch.

FIGS. 3A and 4A are perspective views and FIGS. 3B and 4B are top down views of a first, preferred embodiment of a training aid 200. FIGS. 3A and 3B show the training aid 200 mounted on headwear, which, as shown in the illustrations, is a baseball cap, but may be any kind of headwear, including a headband. Laser pointers 110 are fastened to a mounting means or bar 230 by fastening means 232 that will allow the laser pointers 110 to rotate in a horizontal plane about a vertical axis V that extends through the fastening means 232. The mounting bar 230 has a longitudinal or horizontal axis H and turning the mounting bar 230 about its longitudinal axis H swings the distal end of the laser pointer 110 vertically, thereby providing vertical adjustment of the laser pointer 110. In this preferred embodiment, the vertical orientation of both laser pointers 110 is controlled simultaneously by rotation of the mounting bar 230.

The mounting bar 230 is rotatably captured within a switchbox 240. The switchbox 240 contains battery terminals 250 for replaceable batteries that provide power for the laser pointers 110. An ON/OFF switch 241 is provided on the switchbox 240 for activating both of the laser pointers 110. In the embodiment shown, the mounting bar 230 is a hollow tube with a cable aperture 252 and serves as a cable conduit between the switchbox 240 and the laser pointers 110. A cable (not shown) is insertable into the mounting bar 230 and provides the electrical connection between the battery terminals 250 and the laser pointers 110. It is well known in the art to do this and this feature is not described in any detail.

The switchbox 240 has two mounting bar apertures 242, one on each side of the box, through which the mounting bar 230 is inserted. The apertures 242 are sized to provide a friction-fit with the mounting bar 230 that will allow the bar to be rotated when torque is applied, but will hold the bar in its position when torque is no longer applied.

The switchbox 240 is also equipped with headwear mounting means 246. In the embodiment shown in FIG. 4B, the headwear mounting means 246 comprises small apertures for attaching the box to headwear by means of a rivet or other type of fastener. Other types of fasteners are included within the scope of the invention, such as adhesive fasteners, fabric hook-and-loop fasteners, snaps, ties, stretch bands, etc.

Figure 5A:
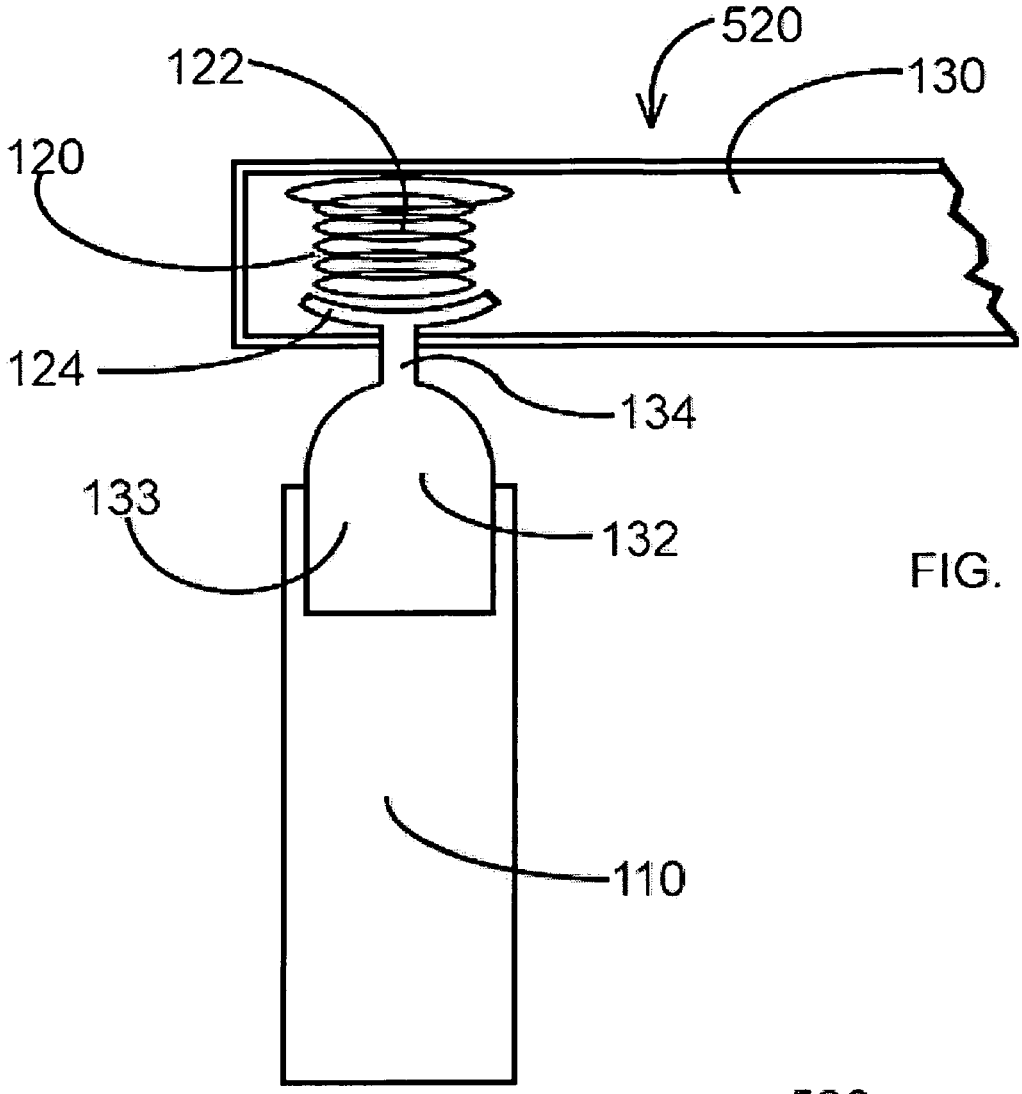
FIG. 5A is a top partial cross-sectional view of a spring-loaded adjustment means.
Figure 5B:
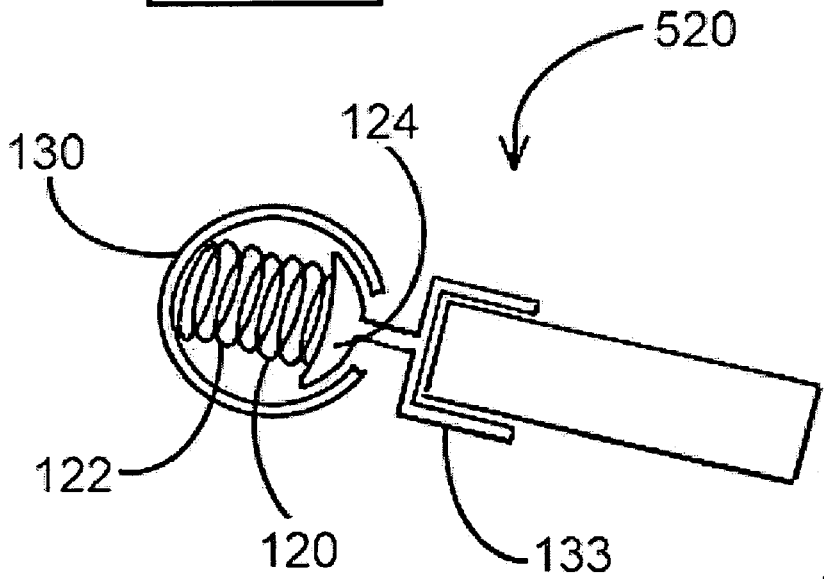
FIG. 5B is a side partial cross-sectional view of the spring-loaded adjustment means, showing a clamp fastening means.

FIGS. 5A and 5B illustrates a spring-loaded adjustment means 520. The fastening means 132 is a clamp 133 that holds the laser pointer 110. The adjustment means 120 is a spring-biased mechanism with a biasing spring 122 and a stop collar 124. In its released position, the biasing spring 124 forces the stop collar 124 against the mounting bar 130 sufficiently tight to prevent the clamp 133 from changing position without force being applied to it. The stop collar 124 is attached to a clamp neck 134 that extends from the body of the clamp 133. The stop collar 124 may be a separate component that is secured on the clamp neck 134 after the clamp 133 has been inserted into an aperture or groove on the mounting bar 130 or may be integrated into the construction of the clamp 133, depending on whether the mounting bar 130 is provided with a groove or an aperture for receiving the clamp neck 134. The orientation of the stop collar 124 may be adjusted vertically or horizontally, within a range permitted by an opening in the wall of the mounting bar by pushing on the clamp 133 in the direction of the stop back of the mounting bar 130. Once the clamp 133 is repositioned to a desirable orientation, it is released and the biasing spring 122 forces the stop collar 124 up against the wall of the mounting bar 130, without changing its orientation.

Figure 6:
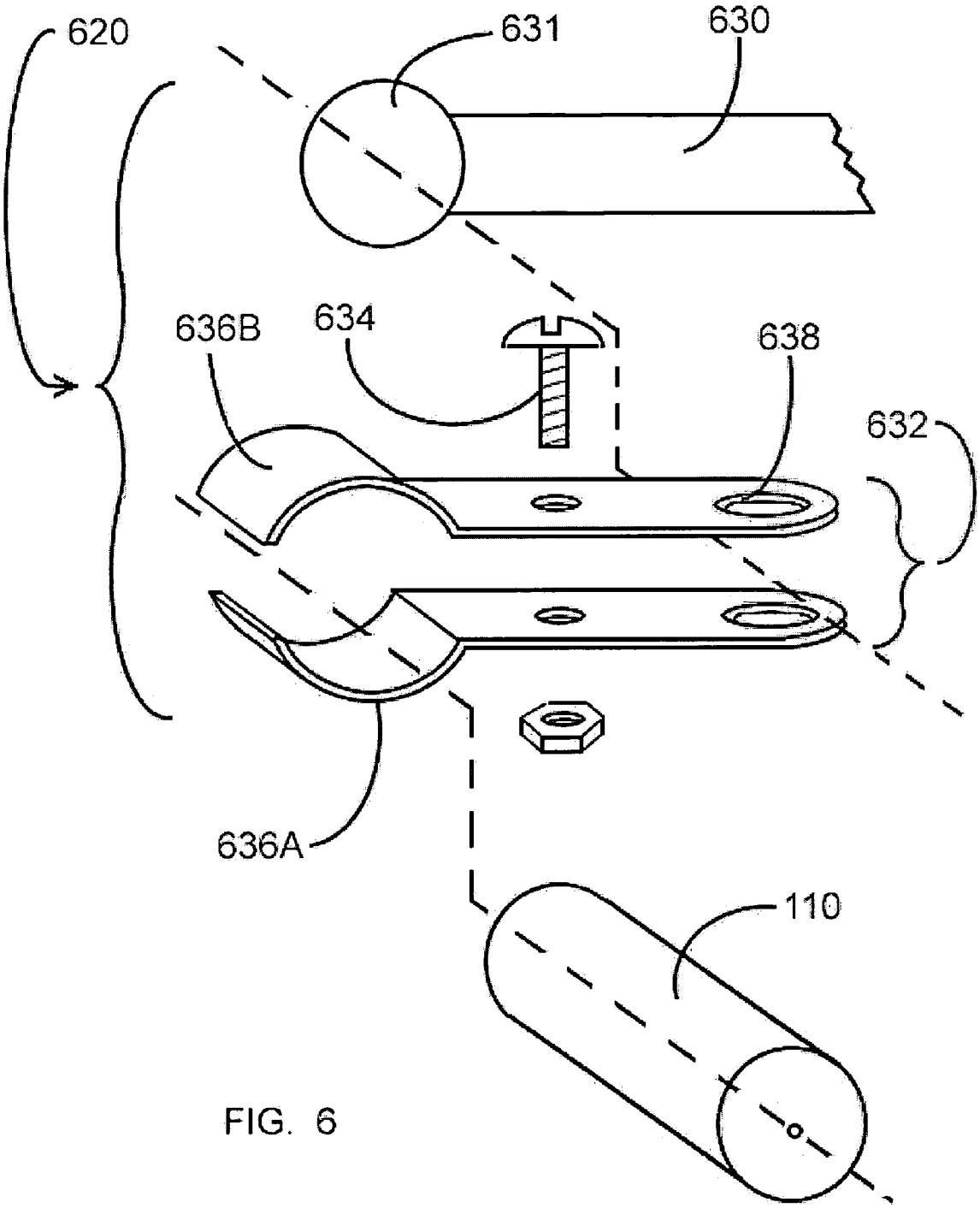
FIG. 6 is an exploded view of a ball-and-socket adjustment means.

FIG. 6 is an exploded view of a ball-and-socket adjustment means 620, comprising a clamping means 632 for adjustably clamping the laser pointer to a mounting means 630. The clamping means 632 includes a clamp 636 that is clampable about a ball 631 provided at the end of the mounting bar 630. The clamp 636 has a first clamp arm 636A and a second clamp arm 636B and a fastening means 634 that holds the two clamps arms 636A/636B together over the ball 631. The fastening means is ideally a threaded fastener or other type of fastener that will allow the clamp arms 636A and 636B to be quickly and easily relaxed or tightened around the ball 631. The clamp arms 636A/636B each have a ball socket 638, such as a recess or a hole. The clamp arms 636A/636B fit around the ball 631 and are movable on the ball 631 vertically and horizontally through an arc that is restricted only by the area of the ball 631 that is attached to the mounting bar 630. In this manner, the orientation of the laser pointer 110 may be adjusted vertically and/or horizontally to the desired position.

The laser pointers 110 are preferably commercially available laser pointers known to the art. Ideally, the laser pointers 110 are battery operated devices using conventional batteries. Such batteries include rechargeable batteries, alkaline batteries, long-life coin-type batteries, etc. An example of a suitable laser pointer is the "lk-2-5in1" sold by Instapark of Santa Fee Springs, Calif. The mounting bars 130, 230, the laser pointer adjustment means 120, 220 and the switchbox 240 are ideally constructed of rigid material such as wood, metal, and plastic, although plastic is the preferred material for cost and weight reasons.

A description of the use of the training aid according to the invention will refer to the training aid 100, although it is clear that the training aid 200 is used in the identical manner. A proper golf swing requires that the golfer keep the head motionless throughout the swing. Thus, while moving the upper, torso and arms through the motions of the swing, the goal is to keep the head in the same location with the eyes on the golf ball, without moving the head to the right or left, forward or back, up or down, regardless of the motion of the torso, arms, legs, and feet. The golfer attaches the training aid 100 to headwear 160, such as a cap or headband, and places the headwear 160 on his or her head. He turns on the laser pointers 110 and, with golf club in hand, addresses the golf ball in a correct stance. He then, while maintaining the correct stance, adjusts the laser pointers 110 so that the first and second light-beams 114A, 114B bracket the golf ball, as illustrated in FIG. 1. The golfer attempts a golf swing. Any movement of the golfer's head during the swing will cause the light-beams 114A/114B to shift relative to the target area. This provides the golfer with instantaneous feed back and aids in training a perfect swing.

It is understood that the embodiments described herein are merely illustrative of the present invention. Variations in the construction of the training aid 100 may be contemplated by one skilled in the art without limiting the intended scope of the invention herein disclosed and as defined by the following claims.

What is claimed is:

1. A training aid comprising:

headwear mounting means adapted for fastening to a piece of headwear;

laser pointers including a first laser pointer that emits a first laser beam and a second laser that emits a second laser beam, said laser pointers adapted for mounting on said headwear mounting means;

laser-pointer adjustment means for adjusting orientation of said laser pointers on said headwear mounting means such that said first laser beam crosses said second laser beam at a point in front of a user wearing said piece of headwear with said laser pointers mounted thereon.

2. The training aid of claim 1, wherein said laser-pointer adjustment means enables horizontal and vertical adjustment of said laser pointers.

3. The training aid of claim 2, wherein said laser pointers are ganged together such that said vertical adjustment of said laser point adjustment means simultaneously adjusts both of said laser pointers.

4. The training aid of claim 1, wherein said laser pointers are battery-operated devices.

5. The training aid of claim 4, wherein said switch-box has battery terminals and battery retainers for receiving batteries, and an ON/OFF switch for selectively providing power to said laser pointers.

6. The training aid of claim 5, wherein said first laser pointer and said second laser pointer are each rotatable in a direction perpendicular to said longitudinal axis.

7. The training aid of claim 1, further comprising a switch-box for providing power to said laser pointers.

8. The training aid of claim 7, wherein said mounting means is a hollow tube having a longitudinal axis and a first end adapted for receiving said first laser pointer and a second end adapted for receiving said second laser pointer, wherein said mounting means is rotatably retained in said switchbox, such that rotating said mounting means about said longitudinal axis provides vertical adjustment of said laser pointers.

9. The training aid of claim 1, wherein said laser adjustment means is a spring-loaded adjustment means assembled on a clamp, wherein said spring-loaded adjustment means includes a spring-biased mechanism and wherein said clamp is adjustable in orientation by simultaneously exerting force on said spring-biased mechanism and adjusting said orientation of said clamp.

10. The training aid of claim 1, wherein said laser adjustment means is a ball-and-socket adjustment means that includes a ball and a clamp with a socket that fits around said ball, and a clamp fastening means for securing said clamp to said ball.

11. The training aid of claim 10, wherein said clamp includes two clamp arms that are fastenable together with said clamp fastening means so as to clamp said laser pointer between a first end of said clamp arms and to clamp said ball between a second end of said clamp arms.

12. The training aid of claim 11, wherein said clamp fastening means is a threaded fastener that adjustably fastens said two clamp arms.

13. The training aid of claim 11, wherein said socket is an aperture provided at said second end of said two clamp arms, said aperture dimensioned to encircle a portion of said ball.

* * * * *